US010113321B2

(12) United States Patent
Bowie

(10) Patent No.: US 10,113,321 B2
(45) Date of Patent: Oct. 30, 2018

(54) DECKING SUPPORT SYSTEM

(71) Applicant: Kinley Systems Limited, Staplecross, East Sussex (GB)

(72) Inventor: Stuart James Bowie, Staplecross (GB)

( * ) Notice: Subject to any disclaimer, the term of this patent is extended or adjusted under 35 U.S.C. 154(b) by 0 days.

(21) Appl. No.: 15/596,125

(22) Filed: May 16, 2017

(65) Prior Publication Data

US 2017/0335572 A1 Nov. 23, 2017

(30) Foreign Application Priority Data

May 17, 2016 (GB) ..... 1608661.3

(51) Int. Cl.

| | |
|---|---|
| ***E04F 15/024*** | (2006.01) |
| ***E04B 5/02*** | (2006.01) |
| ***E04B 5/10*** | (2006.01) |
| ***E04F 15/02*** | (2006.01) |
| *E04B 1/00* | (2006.01) |
| *E04C 3/04* | (2006.01) |

(52) U.S. Cl.

CPC ..... *E04F 15/02458* (2013.01); *E04B 5/023* (2013.01); *E04B 5/10* (2013.01); *E04F 15/02044* (2013.01); *E04F 15/02447* (2013.01); *E04F 15/02452* (2013.01); *E04F 15/02494* (2013.01); *E04B 1/003* (2013.01); *E04C 2003/0456* (2013.01); *E04F 15/02183* (2013.01); *E04F 2015/0205* (2013.01)

(58) Field of Classification Search

CPC ..... E04F 15/02458; E04F 15/02494; E04F 15/02452; E04F 15/02183; E04B 5/023; E04B 5/10; E04B 1/003; E04B 2001/1975; E04B 2001/1933; E04B 5/14; E04B 5/43; E04C 2003/0456; E04C 2003/0408

USPC ..... 52/650.3, 653.1, 655.1

See application file for complete search history.

(56) References Cited

U.S. PATENT DOCUMENTS 5,618,127 A * 4/1997 Tonsmann ..... E06B 3/9616 403/230
7,004,667 B2 * 2/2006 Ludwig ..... E04B 9/14 403/187

FOREIGN PATENT DOCUMENTS

DE 8903341 6/1989
DE 202015005659 10/2015

OTHER PUBLICATIONS

Extended European search report mailed in European Patent Application No. 17169434.2, dated Jul. 26, 2017.

* cited by examiner

*Primary Examiner* — Patrick J Maestri
(74) *Attorney, Agent, or Firm* — Bell & Manning, LLC

(57) ABSTRACT

A decking support system including a plurality of decking support elements, each decking support element including a first decking support engagement feature and a second decking support engagement feature, a plurality of connection elements, each connection element including a first connection feature adapted to co-operate with said first decking support engagement feature of a decking support element, and a second connection feature adapted to co-operate with said second decking support engagement feature of a decking support element, the arrangement being such that a first of said plurality of decking support elements is engageable with a second of said plurality of decking support elements by means of one of said plurality of connection elements dependent on said respective co-operations.

20 Claims, 8 Drawing Sheets

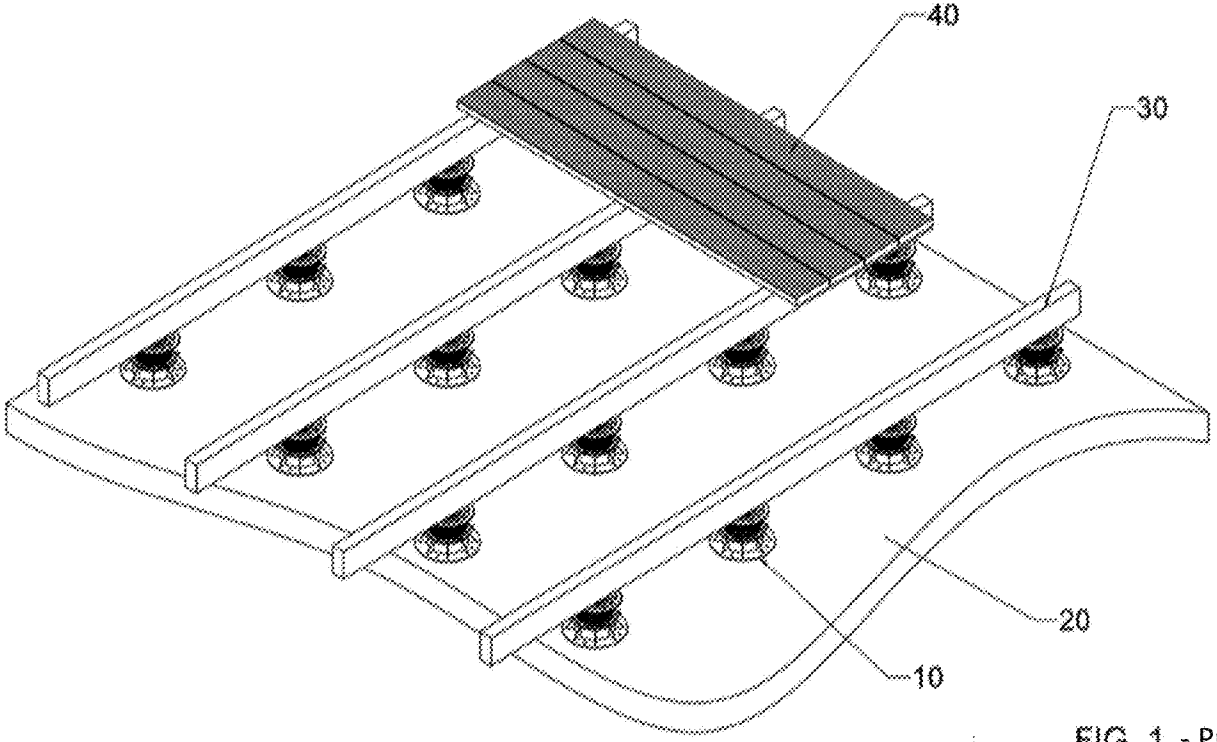
FIG. 1 - Prior Art

DECKING SUPPORT SYSTEM

The present application claims priority to GB Patent Application No. 1608661.3 that was filed May 17, 2016, the entire contents of which is hereby incorporated by reference.

The present invention is directed to a support structure for, for example, decking, or other surfaces.

When houses, office blocks or other structures are constructed an essential step involves arranging for the ground around the structure, or accessible from the structure, to be level, to provide support, and be aesthetically pleasing. This includes walkways, pathways, gardens, patios and other surfaces and can also include terraces and balconies. In addition it is often desirable to utilise spaces that are not traditionally available, for example using a roof to provide a further useful space. Any of these may be developed and will require suitable surfacing.

The solution to the problem of providing a level, supportive and attractive surface around a structure may be solved by installation of decking, generally made of planks of wood, or a wood composite, which is laid side by side, and linked together by for example screws or other conventional means. Traditionally a sub-base aggregate is provided over the ground surface to provide a base for the decking, and in areas where this is not appropriate for example in roof gardens, terraces and balcony designs, in particular where the decking needs to be elevated above the available surface, support pedestals may be provided onto which bearers, generally timber but otherwise composite or Aluminium, may be laid, providing a structure onto which decking planks may be laid to create a surface elevated above the ground. These may be loose laid or fastened in some manner.

One disadvantage of these arrangements is that wood rots and requires maintenance, and even wood composite has a limited lifespan, and despite best efforts to protect the wooden planks or wood composite from, for example, the effects of water and the weather, they still deteriorate over time and the decking of which they form part degrades. In addition the means by which the planks are fixed or linked together, for example by screws, nails or other invasive fixing means, provides points of entry to water and decay which accelerate the damage to which the decking is subject.

There are further irritations in current decking structures, for example the decking can be noisy to walk on due to the planks being laid directly on the bearers.

The present invention is directed to overcoming at least some of these disadvantages.

The present invention provides, according to a first aspect, a decking support system including a plurality of decking support elements, each decking support element including a first decking support engagement feature and a second decking support engagement feature. In addition the present invention provides a plurality of connection elements, each connection element including a first connection feature adapted to co-operate with the first decking support engagement feature of a decking support element, and a second connection feature adapted to co-operate with the second decking support engagement feature of a decking support element. The arrangement is such that a first of the plurality of decking support elements is engageable with a second of the plurality of decking support elements by means of one of the plurality of connection elements dependent on the respective co-operations.

Preferably members of the plurality of decking support elements are thereby engageable together to provide a two dimensional frame with a support surface for decking.

Preferably the first engagement feature of each decking support element is positioned at an end of the element, and the second engagement feature is positioned on a side of the element.

Preferably the members of the plurality of decking support elements are engageable together in an orthogonal orientation.

The present invention provides, according to a second aspect, a decking support element for use in a decking support structure, the decking support element including a first engagement feature and a second engagement feature.

Preferably the decking support element includes two side walls, a top wall and a base wall.

Preferably an internal surface of each side wall includes the first engagement feature.

Preferably the first engagement feature comprises a shelf extending inwardly towards the opposite sidewall.

Preferably the first engagement feature is accessible through an open front end and an open back end.

Preferably an external surface of each side wall includes the second engagement feature.

Preferably the second engagement feature comprises a first trough extending along the length of the sidewall and a second parallel trough extending along the length of the sidewall.

Preferably the front and back ends of the decking support element have a substantially rectangular cross section.

Preferably the first trough is positioned towards a base of the sidewall adjacent a base wall of the decking support element, and the second trough is positioned towards a top of the sidewall adjacent an upper wall of the decking support element.

Preferably the first trough is integral with feet provided on the element.

Preferably the first trough is positioned intermediate the upper wall and base wall, and wherein the second trough is positioned at a top of the sidewall adjacent an upper wall of the decking support element.

Preferably the decking support element further comprises rails positioned above the upper wall, each rail including a channel to receive a resilient strip.

The present invention provides, according to a third aspect, a connection element for use in a decking support structure including a first side including a first engagement structure and a second side including a second engagement structure.

Preferably the first engagement structure comprises a groove.

Preferably the groove is positioned in at least one wall extending outwardly and away from the first side.

Preferably the first engagement structure comprises walls extending outwardly and away from the element.

Preferably the second engagement structure comprises a lip provided at a base of, extending downwardly away from and offset from the second side and a ridge defining a channel positioned towards a top of the second side.

Preferably a top end of the element includes two edge portions and a mid-portion separated from the edge portions by a gap, and wherein the channel is provided in the edge and mid-portions.

Preferably the mid-portion comprises a hooked lever resiliently deformable out of the plane of the second side, the hooked portion contributing to the channel.

Preferably the hooked portion of the hooked lever extends outwardly and away from the second side.

The present invention provides, according to a fourth aspect, a method for providing a support structure for decking comprising providing a plurality of decking support elements, each including a first decking support element engagement feature and a second decking support element engagement feature. In addition, the method includes providing a plurality of connection elements, each including a first connection feature adapted to cooperate with the first decking support element engagement feature and a second connection feature adapted to cooperate with the second decking support engagement feature. The method further includes coupling a first decking support element engagement feature of a first one of the plurality of decking support elements to a first connection feature of one of the plurality of connection elements, then coupling the second connection feature of the connection element to a second decking support engagement feature of a second of the plurality of decking support elements, and coupling further decking support elements together to form a two dimensional frame with a support surface for decking.

Preferably the first decking support element engagement feature is a ledge, and coupling the first decking support element engagement feature to the first connection feature comprises urging the ledge into a groove comprising the first connection feature. Preferably the second connection feature comprises a hooked lip at a base of each connection element and a ridge defining a channel at a top of the connection element, and coupling the second connection feature to the second decking support engagement feature comprises inserting the hooked lip into a lower trough on a side wall of the decking support element and urging the ridge over an outer sidewall of an upper trough on the decking support element.

Preferably urging the ridge over the outer sidewall includes urging a resilient hooked lever forming the second connection feature out of a plane of the sidewall of the connection element.

Preferably the resilient hooked lever provides for a snap fit of the connection element to the decking support element.

The present invention provides, according to a fifth aspect, a kit of parts for providing decking support comprising a plurality of decking support elements engage-able together by means of connection elements, and a plurality of connection elements for engaging together a plurality of decking support elements.

Preferred embodiments of the present invention will now be described by way of example only and with reference to the accompanying drawings in which FIG. 1 shows a conventional decking support system partially constructed, including pedestals with supports in place and with decking planking partially overlaying the supports, FIG. 2A shows a side view of a decking support element in accordance with a first embodiment of the present invention, FIG. 2B shows a cross sectional end view of the decking support element of FIG. 2A, FIG. 3A shows a side view of a taller decking support element in accordance with a second embodiment of the present invention, FIG. 3B shows a cross sectional end view of the decking support element of FIG. 3A, FIG. 4A shows a front view of a connection element in accordance with an embodiment of the present invention, FIG. 4B shows a back view of the connection element of FIG. 3A, FIG. 4C shows a side view of the connection element of FIGS. 3A and 3B, and FIGS. 4D and 4E show perspective views of the connection element of FIGS. 4A-C.

FIG. 1 shows a conventional arrangement for supporting decking in which pedestals 10 are positioned on an original surface 20, and strips 30 are provided to rest on the pedestals and provide a support structure for a decking surface. FIG. 1 shows decking planks 40 partially laid onto the support structure for provision of a decking surface above the original surface 20. Each pedestal may be adapted to be of a height which, when arranged with other pedestals on a surface, ensures that the decking is flat over the entire surface, and, where the original surface is uneven, this can be achieved by for example individual pedestals being 'jacked' to different heights.

Figure 2A:
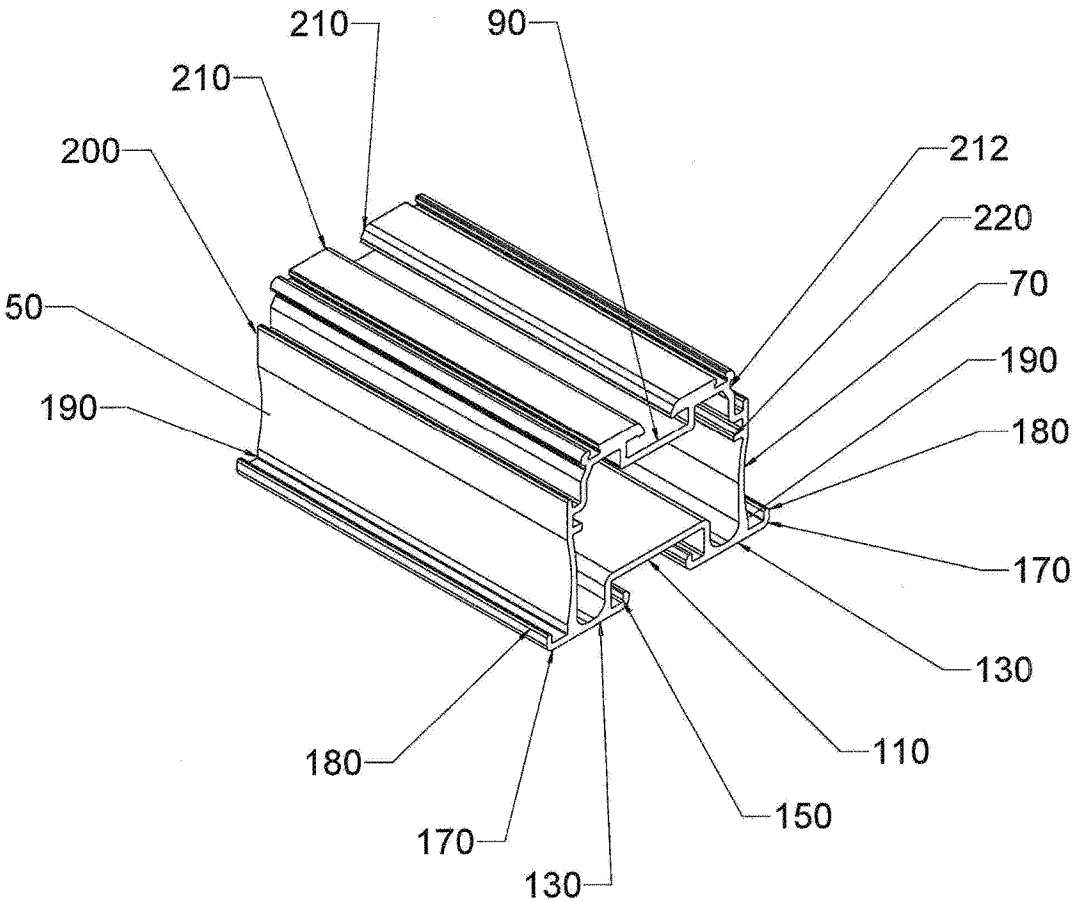
Figure 2B:
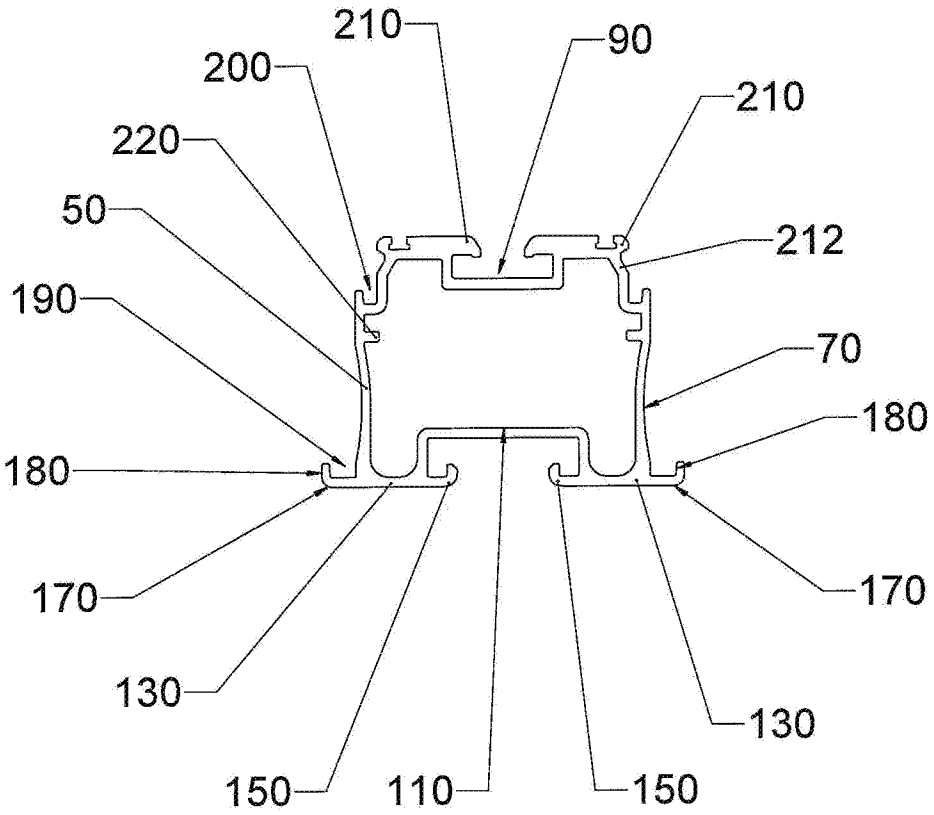

FIG. 2A shows a perspective view of a decking support element 1 each end of which, as shown in FIG. 2B, has a generally square cross section, the decking support element suitable for use as part of a support structure for decking in accordance with the present invention. A plurality of such decking support elements may be laid on pedestals in the manner shown in FIG. 1. Conventionally such support structure components are provided in fixed lengths which are placed end to end or cut to size to suit. The same is contemplated in the present invention.

FIG. 2B shows an end view of the decking support element 1 of FIG. 2A.

As can be seen in FIGS. 2A and 2B, the decking support element includes side walls 50, 70 extending substantially parallel to each other, and upper 90 and lower 110 walls also extending substantially parallel to each other, the longitudinal length of the respective walls defining the length of the element. Feet 130 are positioned at the end of each side wall 50, 70 at the base of the element, extending substantially parallel to the upper and lower walls 90, 110, and orthogonally to side walls 50, 70. An inner portion 150 of each sidewall foot 130 extends inwardly towards the inner portion 150 of the foot of the other sidewall. An outer portion 170 of each foot 130 extends outwardly and away from the respective sidewall 50, 70 and ends in a lip 180 to provide a trough 190 adjacent to and at the base of the sidewall 50, 70.

At a top of each sidewall 50, 70 adjacent the upper wall 90 there is provided a respective exterior trough 200, the upper wall 90 further including a pair of rails 210, each one of the pair adjacent a respective exterior trough 200 and set above the upper wall 90 on respective supports 212. The rails are adapted to each receive a plastics strip (not shown), an upper surface of each of which sits proud of the supports 212.

FIGS. 2A and 2B also show a support strut or shelf 220, on an interior surface of each sidewall 50, 70.

It is contemplated that each decking support element may be placed on a, or on a series of, pedestals 10, arranged on a surface for example the surface 20 of FIG. 1, to be covered with planks of decking 40, or other suitable surface.

Figure 3A:
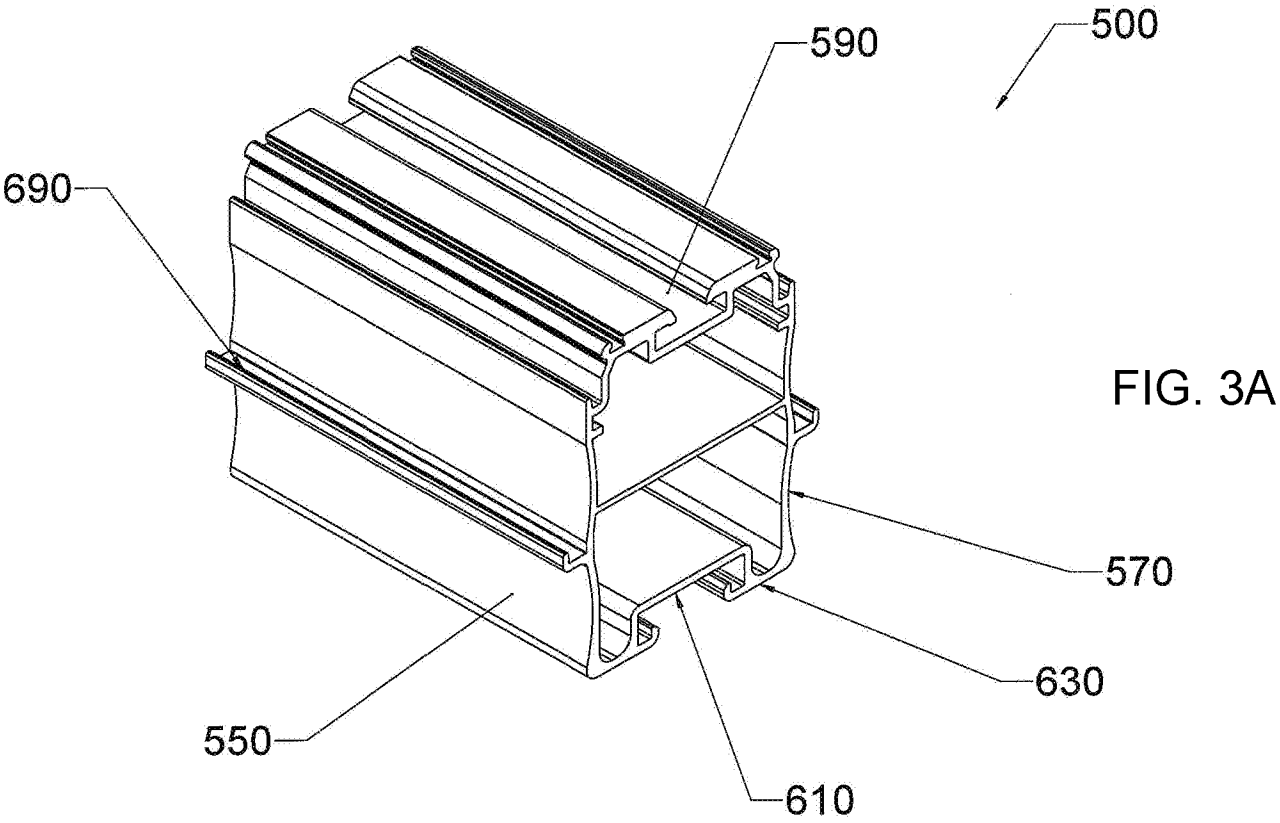

FIG. 3A shows a perspective view of a decking support element 500 with a taller cross section than in the arrangement of FIGS. 2A and 2B, the taller decking support element suitable for use as part of a support structure for decking in accordance with a further embodiment of the present invention.

Figure 3B:
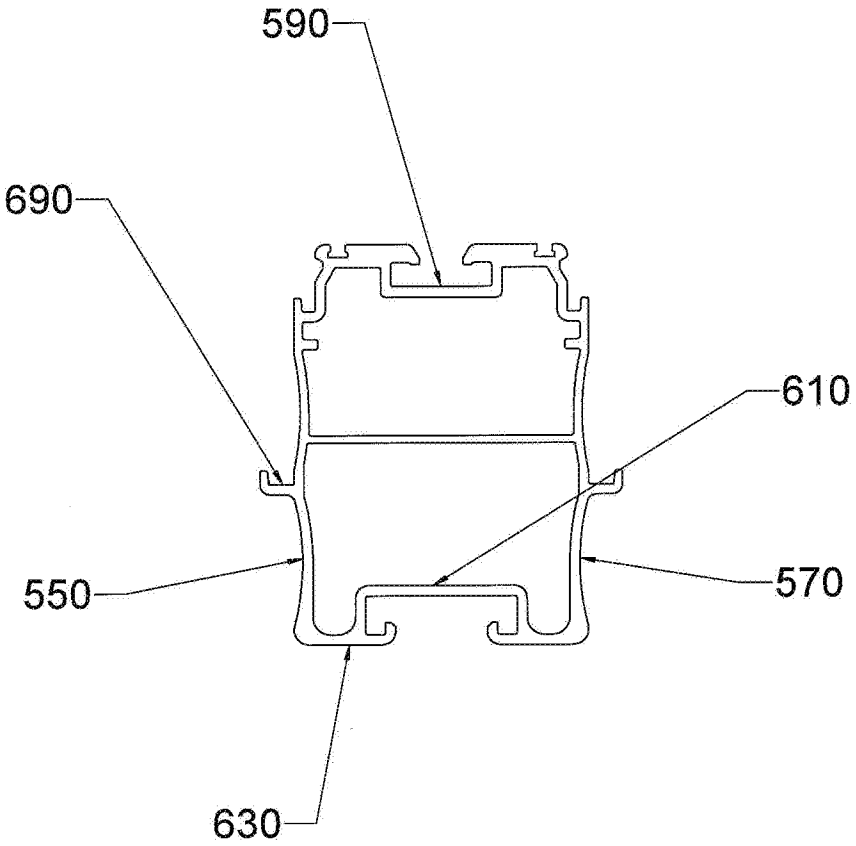

FIG. 3B shows an end view of the taller decking support element 500 of FIG. 3A. It is contemplated that the taller decking support element 500 may also be placed on a, or on a series of, pedestals 10, arranged on a surface for example the surface of FIG. 1 to be covered with planks of decking 40, or other suitable surface.

The taller decking support element of FIGS. 3A and 3B includes sidewalls 550, 570, upper 590 and lower 610 walls, and feet 630, however while each foot includes a portion which extends inwardly towards the other foot there is no additional portion that extends outwardly and away from the sidewall with a lip, as is present in FIGS. 2A and 2B.

Each sidewall 590, 610 of the taller decking support element of FIGS. 3A and 3B includes a trough 690 on an exterior surface, extending along the length of the wall, and equivalent to the trough 190 of FIGS. 2A and 2B but positioned approximately mid-way between the top and bottom of the sidewall, between the upper 590 and lower 610 walls. The top portion of the taller decking support element of FIGS. 3A and 3B is structured in the same manner as the top of the decking support element of FIGS. 2A and 2B.

FIGS. 3A and 3B therefore show a decking support element which is generally of a greater height than the decking support element of FIGS. 2A and 2B, and which provides for a more flexible height gradation than other systems.

FIGS. 4A-E show various views of a connection element in accordance with an embodiment of the present invention.

Figure 4E:
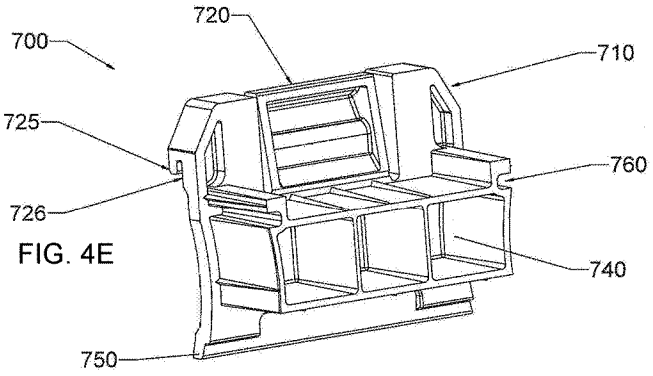
Figure 4B:
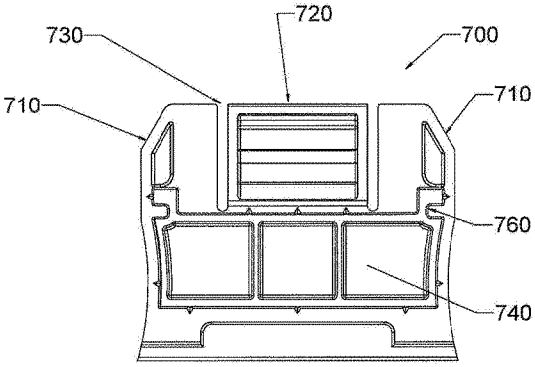
Figure 4C:
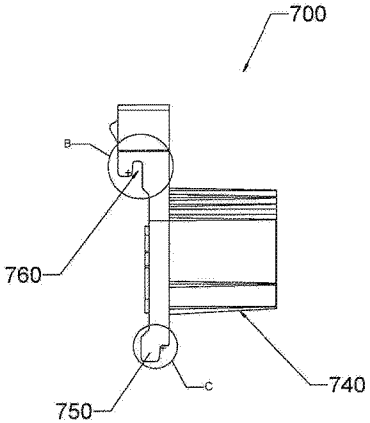
Figure 4D:
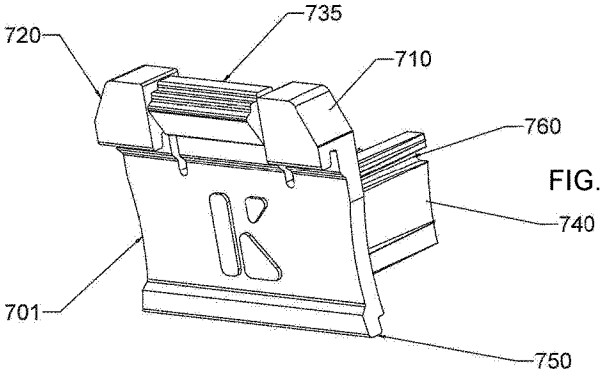
Figure 4A:
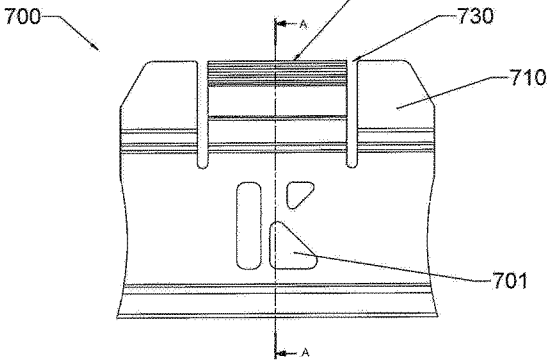

FIG. 4A shows a front view of the connection element 700, with in this case a design 701 positioned on a surface thereof although this is entirely optional. An upper part of the element is divided into three portions, two edge portions 710, and a mid-portion 720 intermediate said edge portions and separated therefrom by a gap 730.

FIG. 4B shows a rear view of the connection element 700 of FIG. 4A, with a rear view of the two edge portions 710 and the mid-portion 720, separated by the gap 730. FIG. 4B also shows structures 740 present on the rear surface of the connection element which are shown more fully in FIGS. 4C-E.

FIG. 4C shows a side view of the connection element 700 of FIGS. 4A and 4B showing the arrangement of the lower portion of the element, in particular showing that the base of the element includes a lip 750 comprising a shelf that first extends away from the substantially planar surface of the element and which then turns downward to extend away from the base portion in a direction broadly parallel to the substantially planar surface of the element. FIG. 4C also shows detail of the structures 740 present on the rear surface of the element, extending away from the element and which will be discussed in more detail in relation to FIGS. 4D and 4E.

FIGS. 4D and 4E show perspective views of the connection element 700 of FIGS. 4A-C from the front and rear respectively. In particular FIG. 4D shows lip 750 at the base of the element; two edge portions 710 and mid-portion 720 on an upper part of the element, and structures 740 present on, and extending away from, the rear surface of the element with a groove 760 present along respective outer side surfaces of structures 740.

FIG. 4E shows in detail structures 740 extending away from the rear surface of the element 700, with the channel 760 positioned therein. As can be seen structures 740 substantially comprise top, base and side walls enclosing open space to provide strength and rigidity while minimising the weight of the element.

As can be seen from FIG. 4E structures 740 are adapted to fit conveniently into open ends of decking support elements, the walls in particular adapted to fit snugly within and against the interior walls of the decking support elements. In accordance with an embodiment shelf 220 provided on an interior surface of a decking support element may be accommodated within a groove 760 which may be provided on a wall of structure 740.

FIG. 4E also shows detail of the edge portions 710 and mid-portion 720 separated by gap 730. As can be seen, the edge and mid-portions include a ridge 725 on an upper surface, generally on the same side of the connection element as that of the lip 750, the ridge 725 defining a channel 726. The mid-portion 720 is separated from the edge portions 710 by a gap and is resiliently deformable out of the plane of the connection element. The mid-portion also includes further surface features 735 which provide some traction on the mid-portion to for example assist with the deformation. As can be seen from FIGS. 4D and 4E these features 735 form a stepped surface.

In use, where it is desired to provide decking on a surface area, for example around a building or on a balcony or other surface, a series of pillars may conventionally be provided to generate a broadly planar surface on which the decking may ultimately be placed. A series of first generally elongate decking support elements 1 in accordance with the present invention may then be placed on the pillars in a uniform, and generally conventional, manner.

The decking support elements may be placed on the pillars, or other support, on feet 130, 630 at a base of the decking support element.

In accordance with the present invention a next step provides for the first decking support elements 1 to be linked with further decking support elements 1 to provide a secure and stable arrangement upon which decking may be placed.

In order to link a first decking support element 1 with a further decking support element 1 a connection element 700 is first coupled to the first decking support element 1, and this occurs in two stages. In a first stage a lip 750 at a base of the connection element 700 is placed in a trough 190 that runs along the base of one of sides 50, 70 of the decking support element 1. In a second stage a top of the connection element 700 is urged towards the top of the decking support element such that ridge 725 positioned at a top of the connection element and curving over to overhang a side of the connection element to provide a channel 726 is urged towards a trough 200 that runs along the upper side wall 50, 70 of the decking support element 1.

The top of the connection element 700 is divided into three portions: a mid-portion 720 intermediate two edge portions 710 and separated therefrom by a gap 730. Mid-portion 720 is resiliently deformable from the plane of the connection element and can deflect away from the plane of the connection element when subjected to a force. When the top of the connection element is urged towards a top of the decking support element ridge 725 abuts an edge of trough 200 and on being further urged towards the top of the decking support element is subject to a force deflecting it out of the plane of the connection element. The mid-portion flexes away from a rest position and eventually slips over the edge of the trough 200 so that the mid-portion snaps back into its rest position, with channel 726 accommodating, and securely held by, an edge of trough 200.

The edge portions also include channels which accommodate the edge of the trough.

The connection element is thereby held securely against a side of the decking support element, with a first side engaged with the decking support element and a second side, with second engagement means, exposed.

A further decking support element may then be attached to the exposed second side of the connection element to couple the two decking support elements together. An open end of the further decking support element is urged towards the exposed second side of the connection element such that the further features 740 enter into the open end, the internal walls of the decking support element accommodating the walls of the further feature, and where present, each shelf 220 entering into respective grooves 760 to secure engagement of the decking support element with the connection element and engagement of the two decking support structures together.

This process can be repeated for other decking support structures and connection structures until all the required decking support structures are engaged together in the desired orientation. It is contemplated that a first decking support structure will be orthogonally coupled to a further decking support structure by a said connection element.

Figure 5B:
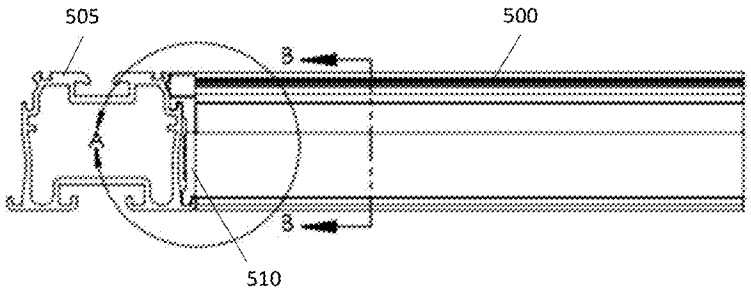
FIG. 5B is a side view of the first decking support element and the second decking support element mounted to one another by the connection element in accordance with an illustrative embodiment.
Figure 5A:
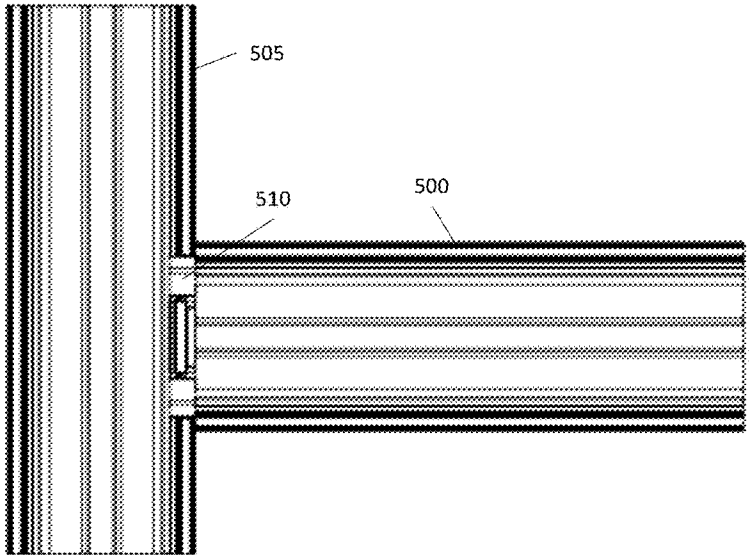
FIG. 5A is a plan view of a first decking support element and a second decking support element mounted to one another by a connection element in accordance with an illustrative embodiment.
Figure 5D:
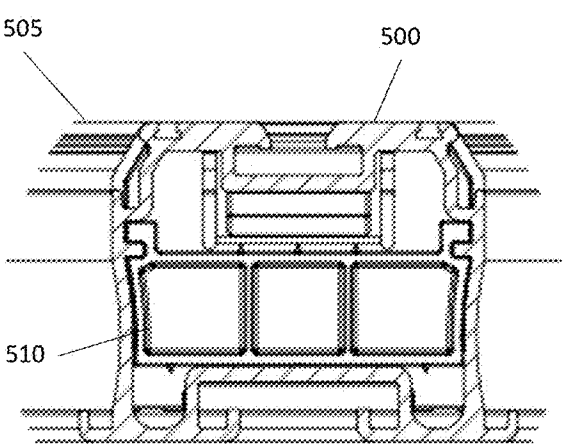
FIG. 5D is a cross-sectional view along line B-B in FIG. 5B that depicts the interface in accordance with an illustrative embodiment.
Figure 5C:
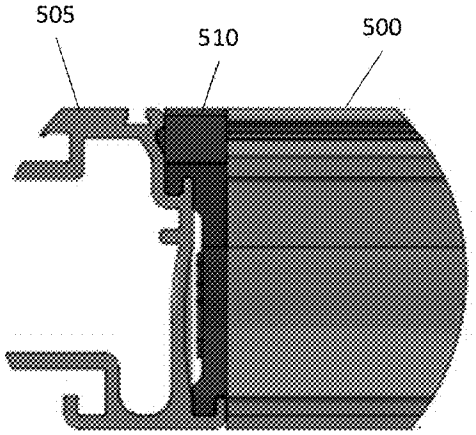
FIG. 5C is a close-up side view of A in FIG. 5B that depicts the interface between the first decking support element, the second decking support element, and the connection element in accordance with an illustrative embodiment.

FIG. 5A is a plan view of a first decking support element 500 and a second decking support element 505 mounted to one another by a connection element 510 in accordance with an illustrative embodiment. FIG. 5B is a side view of the first decking support element 500 and the second decking support 505 element mounted to one another by the connection element 510 in accordance with an illustrative embodiment. FIG. 5C is a close-up side view of A in FIG. 5B that depicts the interface between the first decking support element 500, the second decking support element 505, and the connection element 510 in accordance with an illustrative embodiment. FIG. 5D is a cross-sectional view along line B-B in FIG. 5B that depicts the interface in accordance with an illustrative embodiment.

For decking support elements of a second height, taller than the first height, the connection element engages with a first trough 690 which is positioned intermediate the upper and lower portions of the sidewalls 50, 70, however the further process is the same.

It is contemplated that the decking support structures will be formed from Aluminium or other suitable substance, and the connection structures will be formed from a plastics material.

The invention is not restricted to the details of the foregoing embodiments. For example sidewalls 50, 70, 550, 570 of the decking support elements may be curved or otherwise oriented, the lip 750 on the connection element may include a different shape, the essential feature being that it provides for a feature that may be inserted into a trough and engage with the edges thereof. The lip may be considered to provide a hooking means. The scope of the invention is contemplated to include any one of a variety of means to secure this functionality. In addition, shelf 220 is provided to secure a second side of a connection element within an open end of a decking support element by means of groove 760, however it may be that the walls of structure 740 will, when engaged within walls 50, 70, 550, 570 provide a sufficient engagement. Shelf 220 is provided in part to strengthen the structure of decking support element while minimising the weight of the element and minimising the quantity of material needed for its manufacture. In addition, the features 735 on the surface of the mid-portion 720 can be other features than a stepped surface, any surface feature that provides traction is contemplated to fall within the scope of the invention. While the decking support element is contemplated to be placed on pillars it is contemplated that the arrangement of the present invention is adaptable to be used on different surfaces, for example a conventional surface or on alternative means to provide a planar surface. The pair of rails 210 positioned on a top of said decking support structures may include more or fewer rails, and may be positioned, or shaped, differently. The functionality of the plastics strip provided to the rails may also be accomplished by other means, which are contemplated to fall within the scope of the present invention. The feet of the taller decking support structure may include a portion that extends outwardly and away from the sidewall 550, 570.

The invention claimed is:

1. A decking support system including:

a plurality of decking support elements, each decking support element including a first decking support engagement feature and a second decking support engagement feature, a plurality of connection elements, wherein at least one of the plurality of connection elements includes a first side including a first connection element engagement structure and a second side including a second connection element engagement structure, wherein the first connection element engagement structure includes a first connection feature adapted to co-operate with said first decking support engagement feature of a decking support element, and a second connection feature adapted to co-operate with said second decking support engagement feature of a decking support element, wherein the first connection feature includes at least one wall extending outwardly and away from said first side, and a groove positioned in said at least one wall; and wherein a first of said plurality of decking support elements is adapted to be engaged with a second of said plurality of decking support elements by the at least one of said plurality of connection elements.

2. The decking support system of claim 1, wherein members of said plurality of decking support elements are adapted to be engaged together to provide a two dimensional frame with a support surface for decking.

3. The decking support system of claim 1, wherein said first decking support engagement feature of each decking support element is positioned at an end of said decking support element, and said second decking support engagement feature is positioned on a side of said decking support element.

4. The decking support system of claim 1, wherein members of said plurality of decking support elements are adapted to be engaged together in an orthogonal orientation.

5. A decking support element including a first engagement feature and a second engagement feature, wherein the decking support element is adapted to be used as one of the plurality of decking support elements in the decking support system of claim 1.

6. The decking support element of claim 5 including two side walls, a top wall and a base wall.

7. The decking support element of claim 6, wherein each of the two side walls has an internal surface and the internal surface of each of the two side walls includes said first engagement feature.

8. The decking support element of claim 6, wherein said first engagement feature comprises a shelf extending inwardly from one of the two side walls towards the other of the two side walls.

9. The decking support element of claim 5, wherein the decking support element has an open front end and an open back end and said first engagement feature is accessible through the open front end and the open back end.

10. The decking support element of claim 7, wherein each of the two side walls has an external surface and the external surface of each of the two side walls includes said second engagement feature.

11. The decking support element of claim 10, wherein said second engagement feature comprises a first trough extending along the length of said side wall and a second parallel trough extending along the length of said side wall.

12. The decking support element of 10, further comprising a front end and a back end, and wherein said front and back ends have a substantially rectangular cross section.

13. The decking support element of 12, wherein said first trough is positioned towards a base of said side wall adjacent the base wall of the decking support element, and said second trough is positioned towards a top of said side wall adjacent the top wall of the decking support element.

14. The decking support element of 12, wherein said first trough is positioned intermediate said top wall and base wall, and wherein said second trough is positioned at a top of said side wall adjacent to the top wall of the decking support element.

15. The decking support element of claim 14, wherein said first trough is integral with feet provided on said element.

16. The decking support element of claim 14, further comprising rails positioned above said top wall, each rail including a channel to receive a resilient strip.

17. The connection element of claim 1, wherein said second connection element engagement structure comprises a lip provided at a base of, extending downwardly away from, and offset from, said second side and a ridge defining a channel positioned towards a top of said second side.

18. The connection element of claim 17, wherein the connection element has a top end that includes two edge portions and a mid portion separated from said two edge portions by a gap, and wherein said channel is provided in said two edge portions and said mid portion.

19. The connection element of claim 18, wherein said mid portion comprises a hooked lever resiliently deformable out of a plane of the second side, said hooked lever having a hooked portion contributing to said channel.

20. The connection element of claim 19, wherein said hooked portion of said hooked lever extends outwardly and away from said second side.

* * * * *